US009538585B2

(12) United States Patent
Nordh et al.

(10) Patent No.: US 9,538,585 B2
(45) Date of Patent: Jan. 3, 2017

(54) MICROWAVE HEATING APPARATUS WITH ROTATABLE ANTENNA AND METHOD THEREOF

(75) Inventors: Ulf Nordh, Norrkoping (SE); Hakan Carlsson, Norrkoping (SE); Olle Niklasson, Finspong (SE); Fredrik Hallgren, Kolmarden (SE)

(73) Assignee: Whirlpool Corporation, Benton Harbor, MI (US)

( * ) Notice: Subject to any disclaimer, the term of this patent is extended or adjusted under 35 U.S.C. 154(b) by 820 days.

(21) Appl. No.: 13/150,323

(22) Filed: Jun. 1, 2011

(65) Prior Publication Data

US 2011/0297671 A1 Dec. 8, 2011

(30) Foreign Application Priority Data

Jun. 4, 2010 (EP) ..... 10164955

(51) Int. Cl.
*H05B 6/70* (2006.01)
*H05B 6/72* (2006.01)
*H05B 6/64* (2006.01)

(52) U.S. Cl.
CPC ..... *H05B 6/725* (2013.01); *H05B 6/6494* (2013.01)

(58) Field of Classification Search
CPC ..... H05B 6/72; H05B 6/725; H05B 6/70; H05B 6/705
USPC ..... 219/690, 691, 692, 693, 697, 748, 749,219/380, 746, 751
See application file for complete search history.

(56) References Cited

U.S. PATENT DOCUMENTS 3,857,009 A * 12/1974 MacMaster et al. ..... 219/728
4,327,266 A * 4/1982 Austin ..... H05B 6/74 219/749
4,335,290 A * 6/1982 Teich ..... 219/749
4,568,811 A * 2/1986 Yoshimura ..... H05B 6/6402 219/745

(Continued)

FOREIGN PATENT DOCUMENTS

EP 1315403 A2 5/2003
EP 1434466 A1 6/2004

(Continued)

OTHER PUBLICATIONS

European Search Report for Corresponding EP 10164955.6, Oct. 21, 2010.

*Primary Examiner* — Dana Ross
*Assistant Examiner* — Lindsey C Teaters

(57) ABSTRACT

A microwave heating apparatus and a method for heating/browning a piece of food by means of microwaves are provided. The microwave heating apparatus comprises a cavity arranged to receive, in a substantially horizontal browning region, a piece of food to be browned. The microwave heating apparatus further comprises a microwave source for generating microwaves and a rotatable antenna arranged at the cavity bottom for supplying the generated microwaves. The antenna is configured to produce at least one radiating lobe pointing towards the browning region such that the intersection between the radiating lobe and the browning region forms a hot spot, thereby forming a ring-shaped heating pattern in the browning region under rotation of the antenna. The present invention is advantageous in that a microwave heating apparatus with an improved crisp function is provided.

16 Claims, 2 Drawing Sheets

(56) References Cited

U.S. PATENT DOCUMENTS

| | | | | |
|---|---|---|---|---|
| 4,580,023 | A * | 4/1986 | Simpson | H05B 6/72 219/749 |
| 4,673,783 | A * | 6/1987 | Igarashi | H05B 6/72 219/746 |
| 5,268,546 | A | 12/1993 | Berg | |
| 2003/0121913 | A1* | 7/2003 | Hayami et al. | 219/730 |
| 2008/0238795 | A1* | 10/2008 | Alamouti et al. | 343/768 |

FOREIGN PATENT DOCUMENTS

| | | | |
|---|---|---|---|
| EP | 2031936 | A1 | 3/2009 |
| EP | 2051563 | A1 | 4/2009 |

* cited by examiner

MICROWAVE HEATING APPARATUS WITH ROTATABLE ANTENNA AND METHOD THEREOF

BACKGROUND OF THE INVENTION

Field of the Invention

The present invention relates to the field of microwave heating. In particular, the present invention relates to a microwave heating apparatus equipped with a rotatable antenna for providing an improved crisp function.

Description of the Related Art

The art of microwave heating involves feeding of microwave energy into a cavity. Although the basic function of a microwave oven is to heat food by dielectric heating, microwave ovens have been developed to include additional kinds of cooking capabilities, such as e.g. a crisp or browning function, thereby enabling preparation of various types of food items and providing new culinary effects.

An example of such a microwave oven is for instance described in U.S. Pat. No. 5,268,546 wherein the microwave oven comprises browning means. The browning means includes a layer of ferrite material for absorbing microwave energy and generating heat and a metal browning plate in contact with the layer of ferrite material for browning food. For supplying microwaves to the oven cavity, an input opening is provided at the bottom of a side wall of the cavity such that polarized microwaves propagate between the cavity bottom and the browning means. As a result, a high amplitude standing wave is formed in the space comprised between the metal surfaces of the cavity bottom and the browning plate and the layer of ferrite material becomes hot due to microwave absorption. As the microwaves are fed from a side wall of the cavity, a drawback of such a prior art microwave oven is that the heating of the ferrite of the browning means is not very uniform and the crisp function suffers from unevenness.

Reduction of the unevenness of the crisp function may be obtained by rotation of the browning means or browning plate (in the following, no particular distinction is made between a crisp plate and a browning plate and reference to a crisp plate could equally be made to a browning plate and vice versa). For this purpose, the browning plate is preferably of a circular shape and fitted to be carried by a rotating bottom plate in the microwave oven. Although a satisfying crisp function may be provided by such a technique, a drawback is that the user is limited to use containers that can be rotated inside the cavity, thereby putting rather severe limits on the container size and shape. In addition, the design of the cavity itself is limited since browning functions provided according to such prior art techniques (i.e. based on side wall feeding at the bottom of the cavity) are sensitive to both the cavity dimensions and the position of the port feeding the microwaves at the side wall.

Thus, there is a need for providing alternatives and/or new devices that would overcome, or at least alleviate or mitigate, at least some of the above mentioned drawbacks.

SUMMARY OF THE INVENTION

It is with respect to the above considerations that the present invention has been made. The present invention provides an improved alternative to the above mentioned technique and prior art.

More specifically, the present invention provides a microwave heating apparatus and a method with an improved crisp function.

Hence, according to a first aspect of the present invention, a microwave heating apparatus is provided. The microwave heating apparatus comprises a cavity arranged to receive, in a substantially horizontal browning region, a piece of food to be browned. The microwave heating apparatus further comprises a microwave source for generating microwaves and a rotatable antenna arranged at the cavity bottom for supplying the generated microwaves. The antenna is configured to produce at least one radiating lobe pointing towards the browning region such that the intersection between the radiating lobe and the browning region forms a hot spot, thereby forming a ring-shaped heating pattern in the browning region under rotation of the antenna.

Hence, according to a second aspect of the present invention, a method of operating a microwave heating apparatus comprising a cavity arranged to receive, in a substantially horizontal browning region, a piece of food to be browned is provided. In this method, an antenna arranged at the cavity bottom is rotated to supply microwaves by producing at least one radiating lobe such that the intersection between the radiating lobe and the browning region forms a hot spot and provide a ring-shaped heating pattern in the browning region under rotation of the antenna.

The present invention makes use of an understanding that a rotatable antenna may be provided at the cavity bottom for supplying microwave energy to a (substantially) horizontal region of the cavity where browning is desired, i.e. a browning region or area (or plane). For this purpose, the antenna is configured to produce at least one radiating lobe pointing towards the browning region such that the intersection between the radiating lobe and the browning region forms a hot spot. As the antenna rotates, the radiating lobe (and consequently the hot spot) moves relative to the browning region, thereby forming a ring-shaped heating pattern in the browning region. In the present invention, a hot spot with a relatively high power is provided at a local point in the browning region, which, in combination with the rotation of the antenna (and thereby movement of the hot spot), results in a ring-shaped pattern covering part of the browning region. Further, at the intersection between the radiating lobe and the browning region, a spot with a high concentrated power is provided, thereby enabling an effective crisp (or browning) function.

The present invention can provide a browning function in a browning region without the need for rotation of the piece of food or any receptacle containing the piece of food since it is the antenna that rotates and not a turntable (or the like) on which the food may be arranged.

In this respect, with the term "substantially horizontal" it is meant that the browning region does not need to be exactly horizontal and that some tolerance is envisaged. However, the browning region is advantageously sufficiently horizontal or flat for the intended application, i.e. such that a piece of food can reasonably be held in place in the browning region to be browned.

Further, the present invention is advantageous in that it facilitates the design of a microwave oven since the crisp function is in principle very little dependent on the cavity dimensions and the exact position of the microwave supply for the browning function into the cavity as compared to prior art techniques.

According to the present invention, the risk of overheating of an object arranged in the browning region is reduced due to the movement of the hot spot when the antenna rotates.

According to an embodiment, the antenna may be configured to produce a radiating lobe such that the ring-shaped heating pattern covers about 10 to 50 percent of the browning region area. The percentage of coverage is estimated based on the size of the hot spot and as an effect of the rotation of the antenna (i.e. without taking into account any effect of thermal conductivity in the browning region which will be discussed later).

In particular, for increasing the coverage area, the antenna may be configured such that the radiating lobe is inclined, thereby providing a relatively larger hot spot as compared to a hot spot resulting from a horizontal or vertical radiating lobe. The combination of the rather large size of the power dissipating hot-spot and the resulting very strong heating leads to an effective crisp function.

According to another embodiment, the antenna may be configured to produce a radiating lobe pointing in a direction forming an angle comprised in the range of 0-90 degrees, and more preferably in a range of 30-60 degrees, with the browning region. It will be appreciated that, even for an angle of 0 degree, i.e. for a horizontal radiating lobe, some heating may be obtained at the edge of the browning region.

According to an embodiment, the rotatable antenna may be configured such that a radiating lobe points at the periphery of the browning region, i.e. in a region close to the periphery of the browning region. Indeed, for an antenna producing at least one radiating lobe, it might be advantageous that the radiating lobe points in a region between the periphery and the center of the browning region such that a uniform heating is provided in the browning region. However, if the antenna is configured to produce several radiating lobes and thereby provide multiple ring-shaped heating patterns in the browning region, such as described in some of the following embodiments, it may be advantageous that one of the radiating lobes points close to the periphery while the other ones point to a region in between the periphery and the center of the browning region (e.g., at the midpoint between the periphery and the center).

According to an embodiment, the rotatable antenna may comprise a sector-shaped panel arranged at a distance from the cavity bottom for providing at least one opening through which the generated microwaves are supplied. In particular, the distance between the cavity bottom and the sector-shaped panel of the rotatable antenna together with the sector geometry define the level of the microwave power supplied from the antenna via the opening.

According to an embodiment, the rotatable antenna may be configured to produce at least two radiating lobes directed towards the browning region at two different locations of the browning region. The two radiating lobes may be emitted from the antenna via e.g. two separate radiating apertures. The present embodiment is advantageous in that the two radiating lobes will result in two ring-shaped heating patterns covering two different areas of the browning region, thereby increasing the coverage area of the browning region and the uniformity of the crisp function.

In addition, dividing the available power between two radiating lobes may be advantageous from a design perspective since the power of each radiating lobe can be adjusted depending on the geometry of the antenna and geometry of, and distance between, the radiating apertures from which the two radiating lobes are emitted. The inter-distance between the two apertures influences, by means of constructive/destructive interference, where, in the browning region, the hot spot will have its largest amplitude.

According to an embodiment, an edge (or side) of the sector-shaped panel defining an opening at which microwaves exit the antenna may be curved. The present embodiment is advantageous in that the radius of curvature defines the direction at which a radiating lobe exits the opening, thereby providing a parameter for an effective design of the antenna of the microwave heating apparatus.

According to an embodiment, a top side of the rotatable antenna may comprise an opening defining a top aperture, e.g. a rectangular aperture, from which microwaves may exit the antenna. This embodiment is advantageous in that one more degree of flexibility in designing the microwave heating apparatus and, in particular, the antenna is provided.

According to an embodiment, if the antenna comprises such a top aperture, the microwave heating apparatus may further comprise a spring-loaded piece adapted to move between a position in which the top aperture is at least partially covered and a position in which the top aperture is not covered depending on the rotation speed of the antenna. The present embodiment is advantageous in that it provides a system for preventing undesired heating via the top aperture. Indeed, the top aperture may induce some undesired heating if it emits microwaves when a load other than a browning plate is arranged in the microwave heating apparatus.

For a microwave heating apparatus such as a microwave oven equipped with a browning plate, it may therefore be envisaged that the microwave heating apparatus comprises such a spring-loaded piece and a control unit configured to control the crisp function. For example, if a user selects the crisp function and inserts a browning plate in the microwave heating apparatus, the control unit may be configured to activate the motor connected to the rotatable antenna and thereby open the top aperture for emission of microwaves under the effect of the rotation of the antenna since the spring-loaded piece would not cover the aperture. The antenna motor may be a motor with adjustable speed, whereby the rotation speed of the antenna is increased and the spring-loaded piece moves away from the top aperture, thereby resulting in emission of microwaves via the top aperture.

According to an embodiment, the microwave heating apparatus may comprise a browning plate to receive the piece of food to be browned. In particular, the browning plate may comprise a first part adapted to absorb microwave energy and transform the absorbed microwave energy into heat and a second part arranged in thermal contact with the first part, the second part being configured to receive the piece of food. The present embodiment is advantageous in that the coverage area of the heating pattern in the browning region is further increased due to thermal conductivity. The coverage area may therefore exceed 50 percent of the browning region.

According to an embodiment, the size of the browning plate (or region) may be larger than the size of the rotatable antenna. Further, the size of the antenna relative to the browning plate may determine the position at which the hot spot is positioned. The hot spot, and thereby the ring-shaped heating pattern, may then advantageously be positioned between the periphery of the browning plate and its center.

According to an embodiment, the microwave heating apparatus may comprise a browning plate configured to reduce (or even eliminate) the horizontal coupling of microwaves from the compartment of the cavity defined by the bottom of the cavity and the browning plate to the rest of the cavity, i.e. the cavity volume, which is advantageous in that all power radiated by the rotatable antenna may in principle be used for browning (and the amplitude of the cavity volume mode is negligible). Such a microwave heating apparatus may then be configured to only activate the crisp function via the rotatable antenna at the bottom of the cavity, thereby providing a microwave heating apparatus adapted for frying purposes.

According to another embodiment or in combination with the embodiment including a browning plate configured to reduce horizontal coupling to the rest of the cavity, the microwave heating apparatus may comprise a separate feeding structure with an additional feeding port for feeding microwaves in an upper part of the cavity (e.g. an additional feeding port arranged in the cavity ceiling). The microwaves supplied via the additional feeding port of the separate feeding structure may be generated by a separate microwave source. Alternatively, the feeding port of this separate feeding structure may be fed via a branch from the transmission line that feeds the rotatable antenna at the bottom of the cavity and the available power from the microwave source may then be divided between these branches of transmission line. In this embodiment, all power radiated by the rotatable antenna is in principle used for browning while all power radiated via the feeding port of the separate feeding structure serves for excitation of the cavity volume modes and is thus used for dielectric heating.

According to an embodiment, the microwave heating apparatus may comprise holding means for holding a container in which the piece of food is located. The holding means may be arranged such that the container is positioned in the browning region. The present embodiment is advantageous in that a container comprising an integrated system for absorbing the microwave energy and converting the microwave energy into heat can be arranged in the microwave heating apparatus for providing a crisp cooking function, without the need of a separate browning plate.

Further features of, and advantages with, the present invention will become apparent when studying the following detailed disclosure, the drawings and the appended claims. Those skilled in the art realize that different features of the present invention can be combined to create embodiments other than those described in the following.

BRIEF DESCRIPTION OF THE DRAWINGS

The above, as well as additional features and advantages of the present invention, will be better understood through the following illustrative and non-limiting detailed description of preferred embodiments of the present invention, with reference to the appended drawings, in which.

All the figures are schematic, not necessarily to scale, and generally only show parts which are necessary in order to elucidate the invention, wherein other parts may be omitted or merely suggested.

DETAILED DESCRIPTION OF THE PREFERRED EMBODIMENTS

Figure 1:
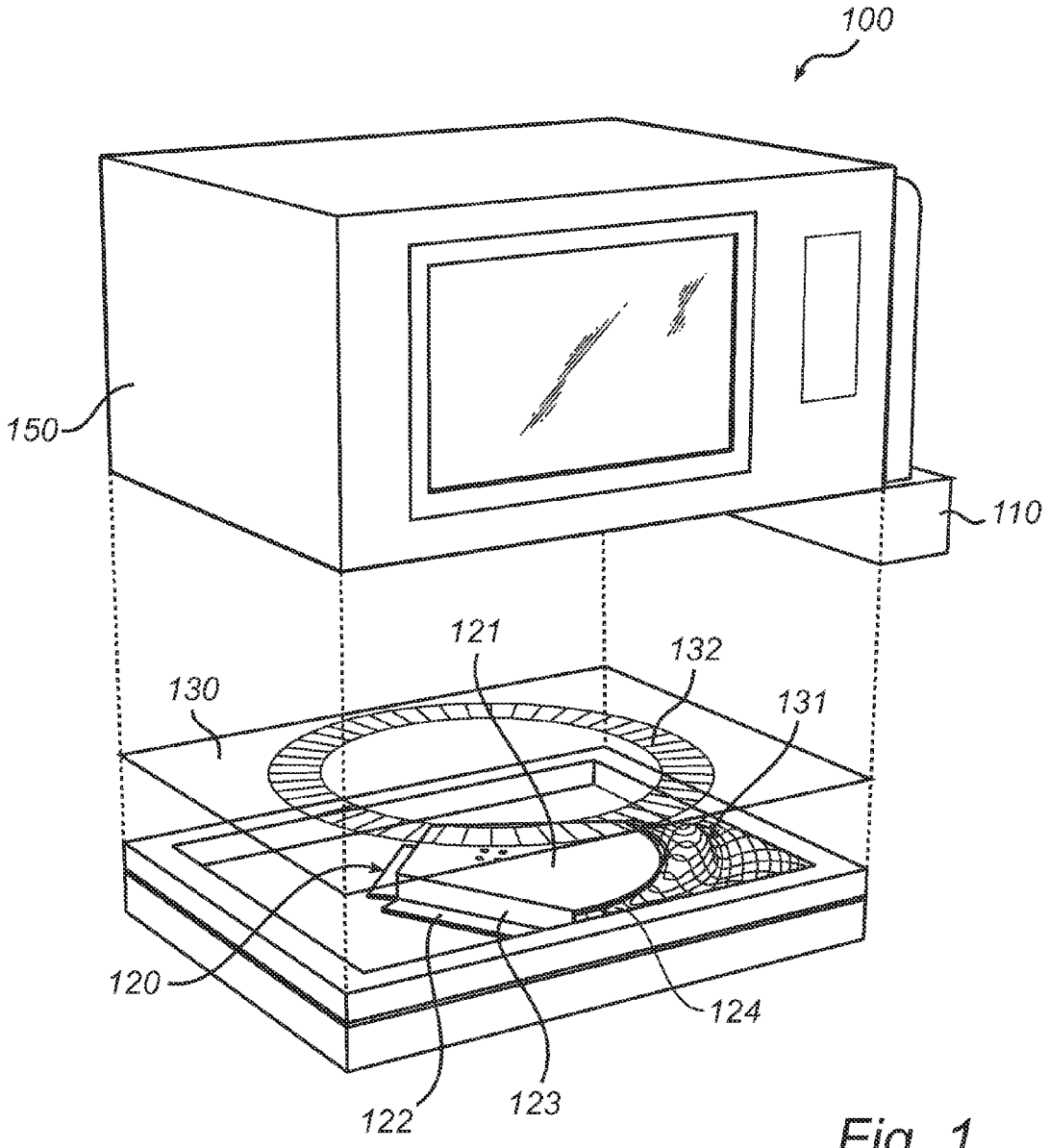
FIG. 1 schematically shows a microwave heating apparatus according to an embodiment of the present invention.

With reference to FIG. 1, there is shown a microwave heating apparatus in accordance with an embodiment of the present invention.

FIG. 1 shows a microwave heating apparatus 100, e.g. a microwave oven, comprising a cavity 150, a rotatable antenna 120 and a microwave source 110. The cavity 150 is arranged to receive, in a substantially horizontal browning region 130, a piece of food to be browned. In FIG. 1, the browning region 130 is represented by a horizontal plane covering the whole section of the cavity 150. However, it will be appreciated that the browning region 130 may be defined to be slightly smaller than the whole area of the section of the cavity 150 in a horizontal plane. The microwave source 110 is adapted to generate microwaves which are supplied by means of, e.g., a transmission line (not shown in FIG. 1) to the rotatable antenna 120. The rotatable antenna 120 is arranged at the cavity bottom for supplying the generated microwaves under the browning region 130. The antenna 120 is configured to produce at least one radiating lobe pointing towards the browning region 130 such that the intersection between the radiating lobe and the browning region 130 forms a hot spot 131, thereby forming a ring-shaped heating pattern 132 in the browning region 130 under rotation of the antenna.

Advantageously, the antenna may be configured to produce a radiating lobe such that the ring-shaped heating pattern 132 covers about 10 to 50 percent of the browning region 130 area (based on the size of the hot spot and as an effect of the rotation of the antenna only).

In particular, the antenna may be configured to produce a radiating lobe pointing in a direction forming an angle comprised in the range of 0-90 degrees (and more preferably in the range of 30-60 degrees) with the browning region 130. Depending on the size of the rotatable antenna 120 relative to the size of the browning region 130 or depending on the location of the antenna opening through which microwaves are generated at the cavity bottom relative to the position of the browning region, the radiating lobe may be directed perpendicular to the browning region or inclined such that the radiating lobe points at the periphery of the browning region 130. As the electromagnetic field is concentrated at a specific point (or hot spot) 131 of the browning region 130, it is advantageous if the radiating lobe is not directed towards the center of the browning region 130 in order to avoid local overheating. Indeed, if the radiating lobe points too close to the center of the browning region, the coverage area of the heating pattern will be limited and the uniformity of the crisp function will be relatively poor. It is thus particularly advantageous if the radiating lobe is inclined and points at the periphery of the browning region 130 since a relatively large ring-shaped pattern 132 may then be created in the browning region 130 under rotation of the antenna 120.

Although various shapes of rotatable antenna are envisaged, the rotatable antenna 120 may comprise a sector-shaped panel 121 arranged at a distance from the cavity bottom for providing at least one opening 124 through which the generated microwaves are supplied. In particular, the distance between the cavity bottom and the sector-shaped panel 121 of the rotatable antenna 120 together with the sector geometry defines the level of the microwave power supplied from the antenna 120 via the opening 124 to the cavity 150. Thus, the distance between the cavity bottom and the sector-shaped panel 121 and the sector geometry itself are parameters that can be used for designing the rotatable antenna 120 and improving the crisp function of the microwave heating apparatus. In particular, the rotatable antenna 120 may be equipped with at least one (substantially horizontal) lateral wing 122 connected to the sector-shaped panel 121 via a (substantially vertical) side wall 123 for providing the opening 124. The height of the side wall 123 may then determine the level of microwave power supplied by the rotatable antenna 120.

Further, the edge of the sector-shaped panel 121 defining with the cavity bottom the opening 124 through which the microwaves are supplied may be curved. In particular, the radius of curvature defines the direction at which the radiating lobe exits the opening. Referring to some of the above concerns, the curve of the edge may then be designed such that the radiating lobe points at the periphery (or any other advantageous locations) in the browning region 130.

Figure 2:
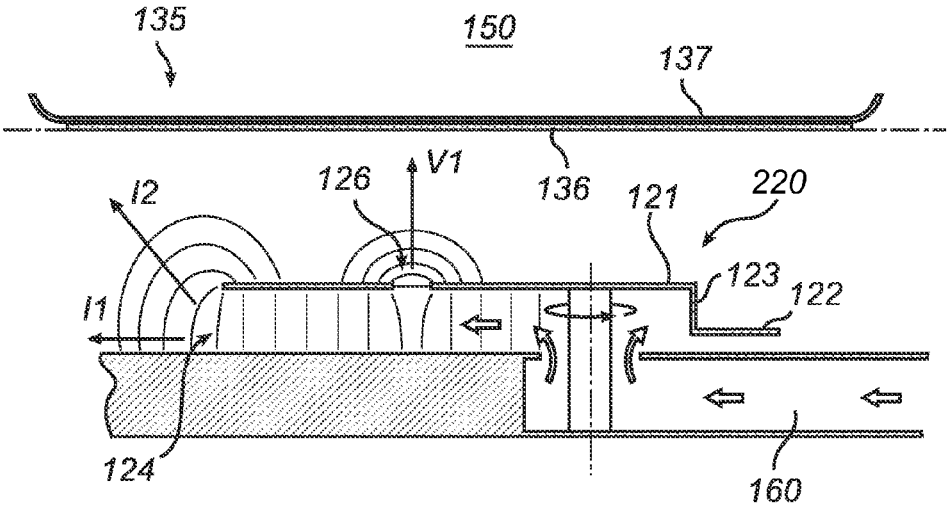
FIG. 2 shows a schematic view of a rotatable antenna and the electric field lines at the bottom of the cavity for a microwave heating apparatus according to another embodiment of the present invention.

With reference to FIG. 2, there is shown a microwave heating apparatus according to another embodiment of the present invention.

In particular, FIG. 2 shows a schematic view of a rotatable antenna 220 and the electric field lines at the bottom of the cavity 150.

The microwave heating apparatus in which the rotatable antenna 220 is mounted may be equivalent to the microwave heating apparatus 100 described with reference to FIG. 1, i.e. comprising a cavity and a rotatable antenna arranged at the bottom of the cavity.

In FIG. 2, the arrows represent the direction of propagation of the microwaves. In this specific example, the microwaves come from the right hand side and propagate in a transmission line 160, which is provided for transmitting microwaves generated by a microwave source (not shown in FIG. 2) to the rotatable antenna 120. The transmission line 160 may be a standard one such as a waveguide, a coaxial cable or a strip line. The microwaves are transmitted from the transmission line 160 to the rotatable antenna 220 via an opening in the cavity bottom in which the rotation axis of the rotatable antenna is arranged. The microwaves are then transmitted from the rotatable antenna via an opening 124.

Further, in FIG. 2, the lines represent the electric field lines, i.e. the electric field vector of the electromagnetic field corresponding to the microwaves emitted from the rotatable antenna 220.

Depending on the design of the rotatable antenna 220 and its boundary conditions, a radiating opening 124 in the antenna may result in one or several radiating lobes, e.g. horizontal and/or inclined lobes. A horizontal radiating lobe may contribute to the excitation of the cavity volume modes whereas the upwardly inclined radiating lobe is conveniently used for forming the hot spot in the browning region 130. If there were only one inclined radiating lobe emitted from the antenna and coupling to the cavity volume mode was desired, the directivity could be adjusted such that the horizontal radiation intensity would not be null or negligible.

Alternatively, it may be considered that the radiating lobe emitted from the opening 124 of the antenna comprises a horizontal part, i.e. a component directed along a horizontal direction 11, and another part directed along an inclined direction 12, as illustrated in FIG. 2. In this case, the horizontal part of the radiating lobe contributes to the excitation of the cavity volume modes while the inclined part is intended to energize a crisp function in the browning region 130.

Advantageously, the rotatable antenna may be configured to produce at least two radiating lobes directed towards the browning region 130 at two different locations of the browning region 130. As a result, two hot spots are created in the browning region 130, which in turn provide two ring-shaped heating patterns at two different places in the browning region, thereby further improving the uniformity of the crisp function.

The rotatable antenna 220 shown in FIG. 2 is generally identical to the rotatable antenna 120 shown in FIG. 1, i.e. comprising a sector-shaped panel 121 with a lateral wing 122 spaced from the sector-shaped panel 121 via a side wall 123, except that the rotatable antenna 220 comprises a top opening 126, e.g. a rectangular aperture, at the top of the sector-shaped panel 121 from which microwaves may exit the antenna 220. Providing an additional top aperture 126 at the top of the sector-shaped panel 121 is advantageous in that it provides an additional supply of microwaves to the browning region 130. Further, as illustrated in FIG. 2, the electric field lines are substantially parallel to the plane defining the browning region 130 in or close to the top aperture 126 but, further away from the aperture, inclined towards a perpendicular direction (as indicated by direction V1 in FIG. 2) relative to the plane defining the browning region 130 due to the boundary conditions and, as a result, a very effective crisp function is provided from the top aperture 126. The rotatable antenna 220 may then be designed such that the right balance in power for the microwaves emitted from the main opening 124 of the rotatable antenna and the top aperture 126 is obtained.

Advantageously, the rotatable antenna 220 may be equipped with a spring-loaded piece (or sheet) of high-epsilon ceramic, for example Titanium dioxide ($TiO_2$), arranged at the top of the sector-shaped panel 121 of the antenna. This spring-loaded piece may be arranged to either cover the aperture arranged at the top of the sector-shaped panel 121 or to be on the side of it. Such a spring-loaded piece is advantageous in that the power transmission through the aperture 126 can be altered depending on the position of the spring-loaded piece wherein the energy transmitted through the aperture 126 when the spring-loaded piece covers (or partially covers) the aperture 126 is significantly lower than (or at least different from) the power transmitted when the spring-loaded piece does not cover the aperture 126. The movement of the ceramic sheet between the two (or more) positions is for example accomplished via the elastic property of the spring-loaded piece in combination with different antenna rotation speeds wherein the "spring" property of the piece causes a release of the ceramic sheet if the rotation speed is above a specific threshold, thereby covering the aperture 126.

Further, for obtaining the crisp function, the microwave heating apparatus may comprise a browning plate 135 arranged to receive the piece of food to be browned and being arranged in the browning region 130. The browning plate may comprise a first part or layer 136 adapted to absorb microwave energy and transform the absorbed microwave energy into heat and a second part or layer 137 arranged in thermal contact with the first part. The second part may advantageously be arranged to receive a piece of food and have relatively good thermal conductivity.

The first part or layer 136, i.e. the microwave-absorbing layer, corresponds to the underside (or the sole) of the crisp or browning plate 135 and the piece of food can be browned on the second part 137, i.e. the thermally conductive layer, at the upper side of the browning plate 135. Generally, the upper side of the crisp or browning plate 135 may consist of an aluminum (or steel) plate which has small thermal mass and good thermal conductivity and possibly a non-stick coating. As already mentioned, in the present specification, no particular distinction is made between a crisp plate and a browning plate and reference to a crisp plate could equally be made to a browning plate and vice versa.

According to the present embodiment, the second part 137 being made of a thermally conductive material provides a uniform browning effect in the browning plate 135. A sufficiently good heat conduction is usually achieved with a metal plate made of e.g. aluminum or steel and the second part 137 enables therefore dissipation of heat in the browning plate. Aluminum has the advantage of having a relatively high heat conduction as compared to steel. However, steel is a more economic alternative.

The underside of the crisp plate (i.e. the first layer 136) may be a ceramic such as rubber-embedded ferrite (in a proportion of about 75% ferrite and 25% silicon dioxide). The ferrite material has a Curie point at which absorption of microwaves in the material ceases. The characteristics for absorption of the microwaves in the ferrite material may be varied by altering the thickness of the layer and/or the composition of the material. Generally, the temperature of the upper side of the crisp plate that comes into contact with the piece of food stabilizes in a temperature range of 130-230° C.

As the antenna is rotated and a uniform crisp function is provided thereof, the browning plate does not necessarily require to be circular and could for instance be rectangular. This is advantageous since the largest user benefit is reached with a rectangular browning plate.

In the present embodiment, the rotatable antenna 120 may provide microwaves to both the sole (i.e. the first part or layer 136) of the crisp plate 135 for energizing a crisp function in the browning region 130 and/or to the cavity for excitation of cavity modes (with or without any browning plate).

In addition to, or as an alternative to, the above mentioned crisp plate arranged to receive a piece of food, the microwave heating apparatus may further comprise holding means for holding a container in which the piece of food is located. The holding means may be arranged such that the container is positioned in the browning region 130. The container would then advantageously comprise a first part or layer adapted to absorb microwave energy and transform the absorbed microwave energy into heat and a second part or layer arranged in thermal contact with the first part, such as described above for the crisp plate. In other words, it may be envisaged that a container comprises an integrated crisp plate and that such a container may be arranged in the cavity by means of specific holding means.

Figure 3:
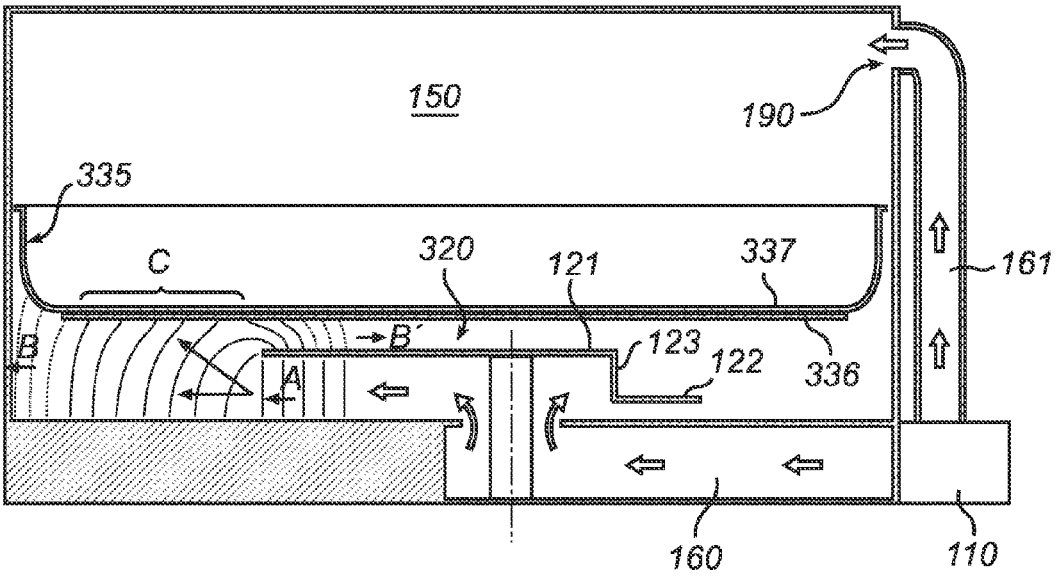
FIG. 3 shows a schematic view of a microwave heating apparatus according to another embodiment of the present invention.

With reference to FIG. 3, there is shown a microwave heating apparatus according to another embodiment of the present invention. The microwave heating apparatus may be identical to the microwave heating apparatus described with reference to FIG. 1 or 2 above. In particular, FIG. 3 shows a schematic view of a rotatable antenna 320 and the electric field lines at the bottom of the cavity 150.

The rotatable antenna 320 is identical to the rotatable antenna 220 described above with reference to FIG. 2 except that it does not comprise an aperture at the top of the sector-shaped panel 121.

As shown in FIG. 3, a specific browning plate 335 configured to limit or eliminate the coupling of microwaves to the cavity 150 is provided. For this purpose, the size of the browning plate 335 may advantageously be large as compared to the size of the rotatable antenna 320.

In the present embodiment, the special browning plate 335 preferably fulfills some suitable boundary conditions for efficiently limiting or quenching the power transmitted to the cavity 150. Thus, in addition to considerations wherein the ferrite/silicone mixture may advantageously be adapted to be highly absorbing in the frequency band of interest, e.g. 2400-2500 MHz, and, have a suitable Curie point and heating time derivative, the overall geometry of the structure may be designed for tuning/limiting the level of power transmitted from the antenna to the cavity. Specific parameters include the distance from the cavity bottom to the browning plate, the distance between the cavity bottom and the rotatable antenna and the own geometry of the browning plate. Additional parameters include the ferrite content and the ferrite chemical and heating properties of the browning plate. It will be appreciated that, although it is advantageous to have a browning plate which is as large as possible, a too large browning plate may result in undesirable arcing between the plate and the cavity walls.

The lines in FIG. 3 illustrates the electric field lines of the microwaves wherein in zones indicated as B and B' the power is significantly lower than in zone A due to strong losses (absorption) in zone C of the first layer 336 of the browning plate 335. Zone C corresponds to an area wherein there is a strong heating caused by the horizontal magnetic field and the vertical electric field of the microwaves in this zone. The power of the microwaves in zone B' depends on dimensions of the structure and, e.g., the distance between the rotatable antenna 320 and the browning plate 335.

The microwave heating apparatus shown in FIG. 3 differs also from the microwave heating apparatuses described above with reference to FIGS. 1 and 2 in that it comprises an additional feeding port 190 for feeding microwaves in an upper part of the cavity 150. The provision of such an additional feeding port 190 is particularly advantageous in combination with the special browning plate 335 described above (i.e. for limiting transmission of microwaves to the cavity 150) but this could also be envisaged in combination with any one of the embodiments described above with reference to FIGS. 1 and 2.

The additional feeding port 190 may be fed via a separate feeding structure connected to a separate microwave source (not shown) or via a transmission line 161 connected to the same microwave source 110 as the microwave source connected to the transmission line 160 feeding microwaves to the rotatable antenna 320. Although the additional feeding port 190 is shown to be arranged at a side wall in an upper part of the cavity, it may also be envisaged to arrange the additional feeding port 190 in the cavity ceiling.

If the same microwave source 110 supplies microwaves to both the rotatable antenna 320 and the additional feeding port 190, the available power from the microwave source 110 may then be divided between the two transmission lines 160 and 161 (or between branches of transmission line).

In combination with the special browning plate 335 described above, all power radiated by the rotatable antenna 320 is in principle used for browning while all power radiated via the feeding port 190 of the separate feeding structure serves for excitation of modes in the cavity volume. Thus, the microwave heating apparatus may further comprise a controlling unit (not shown) for controlling the balance in power transmitted via the rotatable antenna 320 at the bottom of the cavity for energizing the browning function and via the feeding port 190 in the upper part of the cavity for excitation of cavity modes. Optionally, for further improving the cooking performance via the additional feeding port 190 for excitation of the cavity volume mode, the microwave heating apparatus may also comprise a stirring device (not shown) for stirring the microwaves within the cavity volume.

Further, it will be appreciated that, for a microwave heating apparatus comprising the additional feeding port 190 but a standard browning plate 235 such as described with reference to FIG. 2 (i.e. without the particular characteristic of limiting the transmission of microwaves to the cavity 150), cross-talk and unwanted field cancellation or enhancement may occur. Thus, for reducing this effect, the microwave heating apparatus may advantageously be equipped with a switch (not shown) arranged in the transmission line feeding the additional feeding port such that feeding of microwaves to the additional feeding port may be blocked, in particular when the oven is in browning mode. Such a switch may be activated by a control system of the microwave heating apparatus.

According to yet another embodiment, any one of the above mentioned microwave sources may be a solid-state microwave generator (based on e.g. semiconductor elements) or a magnetron. The advantages of a solid-state microwave generator comprise the possibility of controlling the frequency of the generated microwaves, controlling the output power of the generator and an inherent narrow-band spectrum.

While specific embodiments have been described, the skilled person will understand that various modifications and alterations are conceivable within the scope as defined in the appended claims.

For example, although a cavity having a rectangular cross-section is shown in the figures, it is also envisaged to implement the present invention in a cavity having a geometry describable in any orthogonal curve-linear coordinate system, e.g. a cavity having circular cross-section.

We claim:

1. A microwave heating apparatus comprising:

a cavity arranged to receive a piece of food to be browned;

a stationary browning plate having a thermally conductive layer on an upper side for directly receiving the piece of food to be browned, and a microwave absorbing layer on a lower side, the browning plate being arranged in a substantially horizontal browning region configured outward of a center line of the browning plate;

a microwave source for generating microwaves to a central microwave transmission port configured adjacent the center line of the browning plate below the browning region; and a rotatable antenna arranged at the cavity bottom for supplying the generated microwaves, the antenna having a sector-shaped panel arranged at a distance from the cavity bottom for providing a main between the sector-shaped panel and the cavity bottom through which the generated microwaves are supplied and configured to produce at least one radiating lobe pointing towards a periphery of the browning region such that the intersection between the radiating lobe and the browning region forms a hot spot, the antenna also having a single top opening at the top of the sector-shaped panel to form two ring-shaped heating patterns on the browning plate in the browning region under rotation of the antenna, wherein one ring-shaped heating pattern is configured closer to the center line of the browning plate and the central microwave transmission port than another.

2. The microwave heating apparatus of claim 1, wherein the antenna is configured to produce a radiating lobe such that the ring-shaped heating pattern covers about 10 to 50 percent of the browning region.

3. The microwave heating apparatus of claim 1, wherein the antenna is configured to produce a radiating lobe pointing in a direction forming an angle comprised in the range of 0-90 degrees with the browning region.

4. The microwave heating apparatus of claim 1, wherein the antenna is configured such that the radiating lobe points at the periphery of the browning region.

5. The microwave heating apparatus of claim 1, wherein the rotatable antenna comprises a vertical side wall for providing the at least one opening through which the generated microwaves are supplied.

6. The microwave heating apparatus of claim 1, wherein the rotatable antenna is configured to produce at least two radiating lobes directed towards said browning region at two different locations of said browning region.

7. The microwave heating apparatus of claim 1, wherein the edge of the sector-shaped panel defining the opening at which microwaves exit the antenna is curved, the radius of curvature defining the direction at which a radiating lobe exits the opening.

8. The microwave heating apparatus of claim 1, further comprising a cover positioned on the sector-shaped panel, moveable between a position covering the top opening and a position uncovering the top opening to alter transmission through the top opening.

9. The microwave heating apparatus of claim 8, wherein the cover is a spring-loaded piece that moves depending on the rotation speed of the antenna.

10. The microwave heating apparatus of claim 1, wherein the browning plate comprises a first part adapted to absorb microwave energy and transform the absorbed microwave energy into heat and a second part arranged in thermal contact with said first part, said second part being configured to receive a piece of food.

11. The microwave heating apparatus of claim 1, wherein the size of the browning plate is larger than the size of the rotatable antenna.

12. The microwave heating apparatus of claim 1, wherein the browning plate is configured to reduce coupling of microwaves from a compartment of the cavity defined by the bottom of the cavity and the browning plate to the rest of the cavity.

13. The microwave heating apparatus of claim 1, further comprising an additional feeding port for feeding microwaves in an upper part of the cavity.

14. The microwave heating apparatus of claim 1, further comprising holding means for holding a container in which the piece of food is located, said holding means being arranged such that the container is positioned in the browning region.

15. The microwave heating apparatus of claim 1, wherein the antenna is configured to produce a radiating lobe pointing in a direction forming an angle comprised in the range of 30-60 degrees with the browning region.

16. A method of operating a microwave heating apparatus comprising a cavity arranged to receive a piece of food to be browned, the method comprising:

providing a microwave source for generating microwaves to a central microwave transmission port configured adjacent a center line of the cavity;

providing a stationary browning plate having a thermally conductive layer on an upper side for directly receiving the piece of food to be browned, and a microwave absorbing layer on a lower side, the browning plate being arranged in a substantially horizontal browning region configured outward of a center line of the browning plate and the center line of the cavity; and arranging a rotatable antenna at the cavity bottom for supplying microwaves, the antenna having a sector-shaped panel arranged at a distance from the cavity bottom for providing a main opening between the sector-shaped panel and the cavity bottom through which the generated microwaves are supplied and configured to produce at least one radiating lobe, and the antenna having a single top opening at the top of the sector-shaped panel, wherein the intersection between the radiating lobe and the browning region and the single top opening form a hot spot having two ring-shaped heating patterns on the browning plate in the browning region under rotation of the antenna, wherein one ring-shaped heating pattern is configured closer to the center line of the browning plate and the central microwave transmission port than another.

* * * * *